US006209376B1

(12) United States Patent
Zhang

(10) Patent No.: US 6,209,376 B1
(45) Date of Patent: Apr. 3, 2001

(54) ADJUSTABLE SINGLE/DOUBLE SHAFT DRIVEN METAL PRESS MILL

(75) Inventor: Shaoyuan Zhang, Fuzhou (CN)

(73) Assignee: Incisive Technologies, Inc., Piscataway, NJ (US)

( * ) Notice: Subject to any disclaimer, the term of this patent is extended or adjusted under 35 U.S.C. 154(b) by 0 days.

(21) Appl. No.: 09/414,471

(22) Filed: Oct. 7, 1999

(51) Int. Cl.[7] ..... B21B 13/10
(52) U.S. Cl. ..... 72/224
(58) Field of Search ..... 72/224, 226, 237, 72/240, 248, 249

(56) References Cited

U.S. PATENT DOCUMENTS 4,313,325 * 2/1982 Staat et al. ..... 72/224
5,144,827 9/1992 Iio ..... 72/224
5,765,423 * 6/1998 Cattaneo et al. ..... 72/224
5,953,948 * 8/1998 Isozaki ..... 72/249

* cited by examiner

*Primary Examiner*—Rodney A. Butler
(74) *Attorney, Agent, or Firm*—Keusey & Tutunjian, P. C.

(57) ABSTRACT

A metal rolling mill having four rolls arranged in the shape of a cross for the purpose of rolling bar, wire, tube and other specially shaped metal rolling stocks. The roll system forms the core component and includes four rolls mounted on shafts placed at 90° with respect to one another. A single or set of double shafts transmit input or torque from a power source to the roll system and cause the roll shafts to rotate synchronously. The four rolls then press from four mutually perpendicular directions simultaneously on the same section of the metal rolling stock that is being fed through the rolls on the production line. The positions of these rolls can be collectively adjusted within their respective radial plane either mechanically via a remotely controlled device or manually.

9 Claims, 3 Drawing Sheets

ADJUSTABLE SINGLE/DOUBLE SHAFT DRIVEN METAL PRESS MILL

BACKGROUND OF THE INVENTION

1. Field of the Invention

The present invention relates to a metal manufacturing, and more particularly, to a metal rolling mill.

2. Description of the Related Art

Many earlier inventions that relate to the four-roll metal rolling mill design can be found in the following US Patents:

U.S. Pat. No. 2,019,081, titled Universal Roll Mill, by Heinrich Koppel in 1932

U.S. Pat. Nos. 2,041,271 and 2,071,712, titled Roll Stand Unit for a Continuous Reducing Mill, by Heinrich Stutting in 1934

U.S. Pat. No. 2,094,920, titled Rolling Mill, by Heber C. Inslee in 1937

U.S. Pat. No. 2,495,387, titled Mill, by Richard E. Rummins in 1950

All of the inventions above implemented a metal rolling mechanism that was based on four rolls and therefore shared many common characteristics. Most notable of which was that although their respective novel approaches to a four-roll-based design were theoretically and mechanically sound, however, the entailed press systems became extremely complex and bulky. The large number of bevel and other types of gears that are necessarily used in such systems reduce gearing transmission efficiency and subsequently usability of the inventions. This major disadvantage most likely accounts for the reason of why these inventions never saw practical use in the metallurgical industry.

A more interesting and modern instance of prior inventions that was also based on a four-roll mill design can be found in U.S. Pat. No. 5,144,827, titled Rolling Mill Stand, by Itsushi Iio in 1992. This invention far surpassed its predecessors in the 30's and 50's in terms of design and usability. In this invention, a single shaft is used to drive four coplanar shafts that are at right angle with respect to one another. Three pairs of bevel gears on the shafts transmit torque in between the driven shafts at 90° and cause the helical gears and the rolls on the shafts to rotate synchronously. The four driven shafts were made eccentric so that they could rotate off-center to achieve the effect of adjusting parting in between the rolls. After careful analysis of the patent, it was found that the overall design of structure in this invention was relatively novel but not without its shortcoming. The implementation of a single shaft driving two pairs of shafts via three pairs of bevel gears and four pairs of helical gears to attain synchronous rotations of the shafts and rolls resulted in low transmission efficiency and lower structural integrity of the rolling components. Bearings of other types and higher strengths could not be used to remedy the weakness in the components due to structural limitations, which inevitably rendered the overall rolling system incapable of sustaining higher rolling torque. The lack of public knowledge of this invention in the industry today can most likely be traced to these major disadvantages. This present invention aims to eliminate the shortcomings and disadvantages found in various prior inventions as described above and further improve upon the technical merits associated with the four-roll-based design. It is hoped that through this invention, the theoretically superior four-roll technology can finally be flawlessly implemented.

SUMMARY OF THE INVENTION

According to an embodiment of the present invention, the metal rolling mill comprises: a case body; a synchronously rotating four-roll system; and a synchronously adjustable four-roll press device. All components of the mill are contained within the covers of the case body and all are capable of rotation with respect to their own axes. Positioned parallel to the four edges of the case body are the four passive shafts that form the core components of the four roll systems inside the mill casing. A roll is mounted on each of the passive shafts such that its radius is perpendicular to the axis of rotation of the respective shafts. All rolls converge at the center of the mill and form a groove out of the joined contours of their heights. This groove serves as the passage for the steel rolling stock that is to be fed through the mill on a production line and pressed by the four rolls.

In addition to the shaft and the roll, the four roll system comprises an adjustment system which includes two eccentric bearing sleeves encircling the shaft on opposing sides of the roll, ball bearings, at least one spiral bevel gear, at least one adjustment ring, and at least one ring nut. The shaft with the roll is enveloped by two sets of bearing sleeves, one on each side of the roll. Ball bearings disposed under the sleeve contact the shaft. At least one adjustment ring slides along the shaft in between the bearing sleeves. The end of a first shaft not connected to the drive shaft includes a profile-shifted spiral bevel gear. A ring nut installed on the end of the shaft retains the profile-shifted spiral bevel gear in place. The profile-shifted spiral bevel gear on the end of the first passive shaft meshes with another profile-shifted spiral bevel gear on one end of a second shaft perpendicularly positioned with respect to the first shaft. As torque is delivered to the first passive shaft by single or double drive shafts, it is transmitted by the end mounted profile-shifted spiral bevel gears to the profile-shifted spiral bevel gear of the next adjacent shaft (e.g., the second passive shaft). In this manner, torque is propagated at right angles in between all of the passive shafts, and synchronous rotation of all rolls is achieved.

According to a preferred embodiment of the present invention, the external power train that supplies torque to the rolling mill comprises an external DC or AC motor-based electrical power source that generates torque, a coupler connecting such a power source to a gearbox, and a universal joint linking the gearbox to the single or double drive shafts of the rolling mill. Torque is first transmitted from the power source into the gearbox over the coupler, and then from the gearbox to the drive shaft of the rolling mill via the universal joint. The manner of torque transmission within the rolling mill after torque has reached the drive shaft(s) has been described in detail in the previous paragraph.

According to a preferred embodiment of the present invention, the adjustable roll device enables the four-roll rolling mill to have an adjustable roll groove. The adjustable roll device is implemented through a system of eccentric bearing sleeves disposed around the passive shafts on both sides of the roll. Worm drives are perpendicularly disposed through the casing body such that they engage profile-shifted worm gears installed in the mill casing. Two profile-shifted worm gears are positioned so as to tangentially influence the eccentric bearing sleeves from its two adjacent passive shafts. The worm drives are all tipped with sprocket wheels, which are linked together via a chain. Thus, as one of the worm drives is rotated either by hand or a remotely controlled servo device, the chain enables synchronous rotations of all worm drives, which in turn drives the profile-shifted worm gears causing the respective bearing sleeves to rotate synchronously. The eccentric design of the bearing sleeves results in a common deviation of the sleeves' bore centers from their geometric centers resulting in the simultaneous displacement of the axes of rotation of the passive shafts contained within the sleeves by a certain distance away from their original centerlines. This effect creates movement of the rolls in their respective radial planes away from the groove center, thus enabling the controlled adjustment of the groove.

During off-line maintenance, the mill is first taken off the production line and the rolls are removed from the case body. The rolls are then usually sanded down to a smaller diameter to remove the wear and tear on their perimeters. The allowable amount of change in diameter of a roll on a four-roll metal rolling mill falls within a range of 8 to 12 mm or greater depending on production requirements. This means that the mill can be re-deployed with smaller reworked rolls without losing any of its capabilities. Designated roll groove size can be maintained even after the rolls have been retrofitted. This feature of the rolling mill creates an advantage by making the rolls reusable, which consequently increases the versatility of the rolling mill.

The metal rolling mill of the present invention expends less energy than the other roll mill designs during metal processing resulting from the fact that for the same amount of strain produced in the rolling stock, the four-roll mill exerts less relative compression than the others. The decreased relative compression not only requires less input power, but also induces less resistance by the rolling stock to elongation and most importantly, reduces undesirable lateral strain. In addition, the compression applied by the four rolls in four directions is effective in compacting good and imperfect crystalline structure internal to the metal, thereby enhancing the quality of the rolling stock.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings wherein like reference numerals denoted similar elements throughout the views.

DETAILED DESCRIPTION OF THE PRESENTLY PREFERRED EMBODIMENTS

Figure 1:
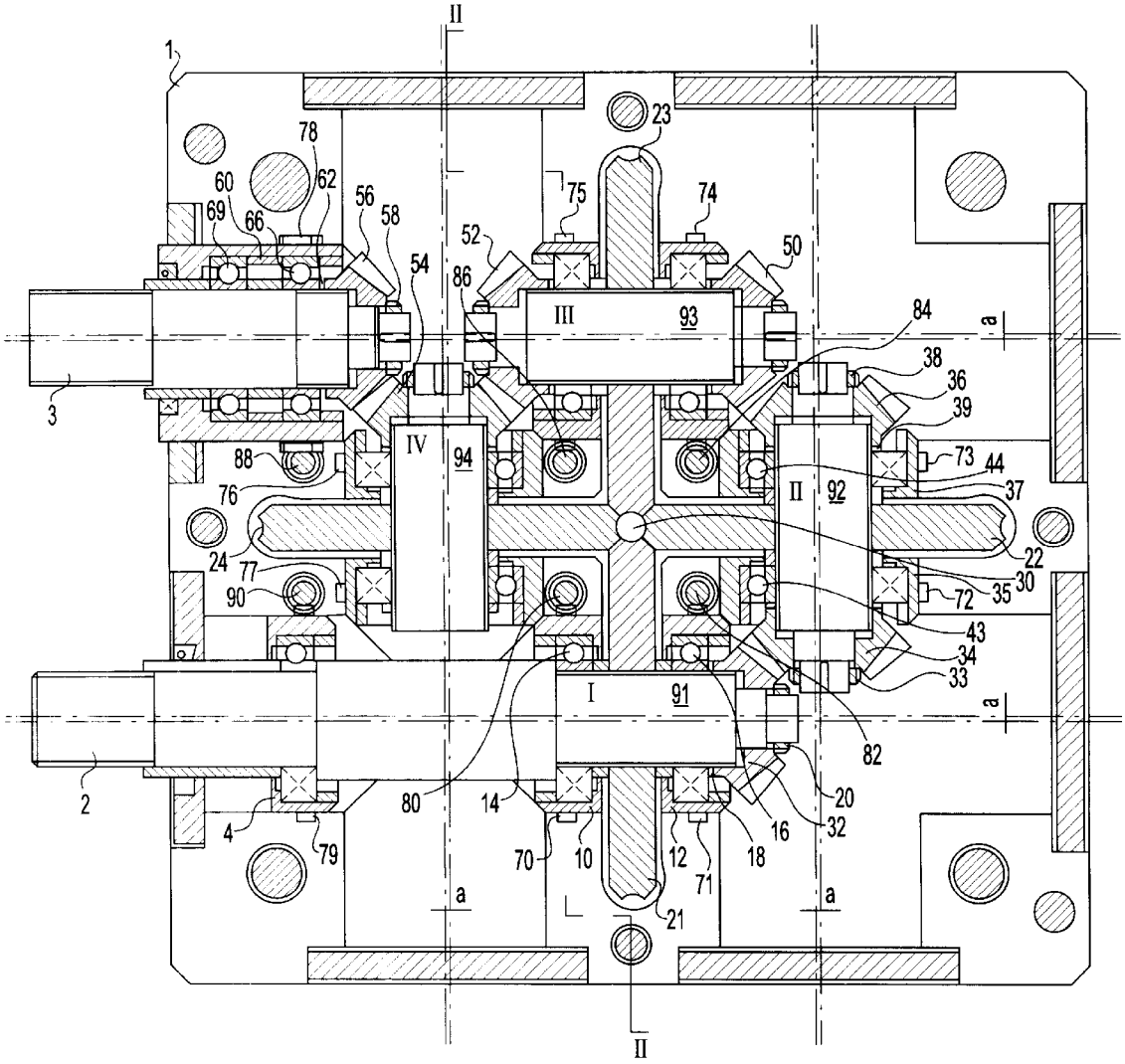
FIG. 1 is a partial sectional view of the four-roll metal rolling mill according to an embodiment of the present invention.

Referring to FIG. 1, there are four roll systems I–IV of identical components and similar layout within the rolling mill unit. Each roll system includes a passive shaft and a roll positioned on the shaft perpendicular to the shaft's axis of rotation. As shown in FIG. 1, passive shafts 91–94 are arranged in the same plane and disposed at right angles with respect to each other so as to form a square. This configuration results in the corresponding rolls 21–24, to form the shape of a cross when viewed from the front of the case body 1. All rolls 21–24 are circular disks with bores at their centers and edges along their heights tapered toward the center plane of the disk. The taper stops at roughly quarter the height and the edge assumes the outline of a quarter circle. The edges along the heights of all rolls 21–24 converge at the center of the case body 1 such that the respective quarter circle contours come together to form a full circular groove 30. The circular groove 30 serves as the passage of the rolling stock being fed through the rolling mill unit.

Figure 3:
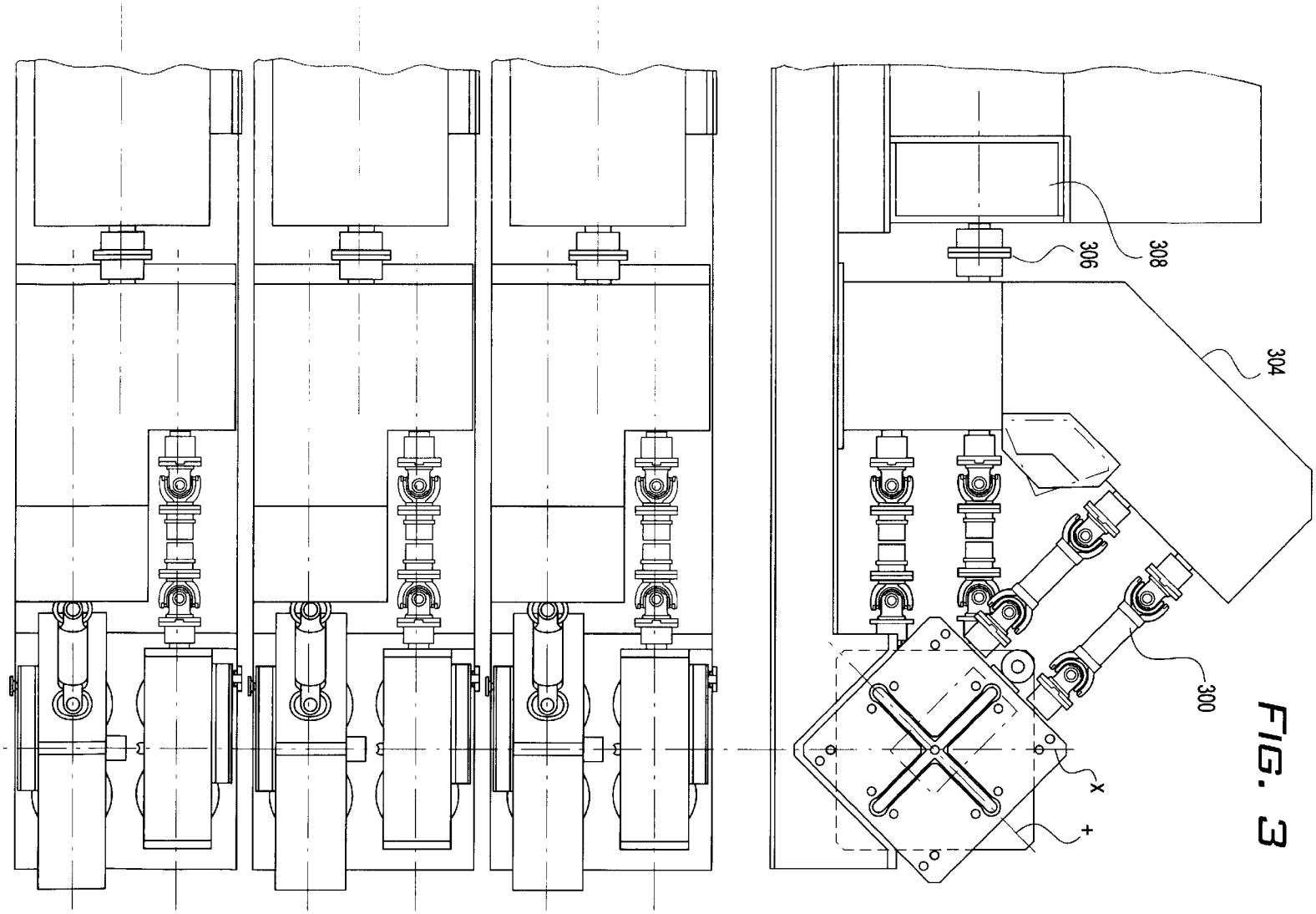
FIG. 3 is a schematic view of a typical production line formed by a sequence of alternating four-roll metal rolling mills of the "x " and "+" configuration.

As shown in FIG. 3, the external end of active shaft 2 connects to a universal joint 300 which in turn connects to a gearbox 304. A coupler 306 then links the gearbox to a DC or AC motor-based power source 308. A bearing sleeve 4 wraps around the middle section of active shaft 2 inside the mill's case body 1, and covers ball bearings that are placed between the shaft 2 and the sleeve 4. The opposing end of shaft 2 is connected with the co-linear shaft 91 of roll system I. Roll system I includes a roll 21, two eccentric bearing sleeves 10, 12 and ball bearings 14, 16. The roll 21 is attached to shaft 91 by having the shaft run through the bore at its center. Two individual bearing sleeves 10, 12 wrap around the sections of the shaft 91 immediately next to the roll 21. Ball bearings 14, 16 are placed within the cover of the bearing sleeves 10, 12 respectively to serve as contact between the inner surface of the bearing sleeves and the outer surface of the shaft 91. Toward the internal end of the shaft 91, an adjustment ring 18 slides over the shaft immediately next to the bearing sleeve 12. A profile-shifted spiral bevel gear 32 is mounted over shaft 91 near its end. A ring nut 20 installed on the end of shaft 2 retains profile-shifted spiral bevel gear 32 in its operable position. Profile-shifted spiral bevel gear 32 is engaged to profile-shifted spiral bevel gear 34 that belongs to the adjacent, perpendicularly disposed, roll system II. Roll systems II and III are identical in construction as that of roll system I with the exception that roll system II is driven by rolls system I and roll system III is driven by roll system II. Roll system IV is driven by roll system III in a similar manner as roll system II drives roll system III however, roll system IV can also be driven by a second external drive shaft 3 as will be described later.

Shaft 92 in roll system II has an axis of rotation (i.e., centerline) that is at a right angle with respect to that of roll system I. The sequence of assembly for roll system II is exactly the same as the roll system I except an additional profile-shifted spiral bevel gear 36 and adjustment ring 38 are found near the other end of the shaft 92. The components of the roll system II are assembled along the shaft 92 in a direction along axis of rotation (centerline) of the shaft toward roll system III in the following sequence: ring nut 33, profile-shifted spiral bevel gear 34, bearing sleeve 35, ball bearings 43, roll 22, bearing sleeve 37, ball bearings 44, adjustment ring 39, profile-shifted spiral bevel gear 36 and ring nut 38. The profile-shifted spiral bevel gear 36 near the end of shaft 92 meshes with a profile-shifted spiral bevel gear 50 of roll system III. The third roll system III, like the systems I and II, has a shaft 93 as its central component, which also lies at a right angle with respect to the shaft 92 of the second roll system II. The third roll system III is identical to the roll system II in terms of components and assembly, so its details will not be discussed here. A profile-shifted spiral bevel gear 54 at the opposite end of shaft 93 is engaged to profile-shifted spiral bevel gear 54 of another roll system IV. Roll system IV is identical to previously described roll systems in components and assembly, with the exception that only one end of shaft 94 has a profile-shifted spiral bevel gear 54. The axis of rotation (centerline) of shaft 94 is perpendicular to the axis of rotation of shaft 93 of roll system III and the common axis of rotation (centerline) of shaft 2 and shaft 91 of roll system I.

FIG. 1 also shows the position of a possible second active shaft 3 that is capable of transmitting torque in addition to that passed from the first active shaft 2 from an external power source. Shaft 3 is equipped with a profile-shifted spiral bevel gear 56 and a ring nut 58 at its internal end. An adjustment ring 62 is slid over the shaft 3 like its counterparts in the four roll systems I–IV between the profile-shifted spiral bevel gear 56 and a bearing sleeve 60. Two sets of ball bearings 64, 66 are placed under sleeve 60 in contact with shaft 3. In the event of extra torque being required, shaft 3 will be connected to a power source in the position shown in FIG. 1 and FIG. 3 and its profile-shifted spiral bevel gear 56 will mesh with profile-shifted spiral bevel gear 54 of roll system IV. Otherwise it will be the fourth passive shaft that rotates along with the other shafts 91–94.

All eccentric bearing sleeves described above are enveloped by profile-shifted worm gears 70–79, which mesh with corresponding worm drives that are inserted through the bores of the case body in planes parallel to those of the rolls. Worm drives 80 simultaneously engages profile-shifted worm gears 70 and 77, worm drive 82 simultaneously engages profile-shifted worm gears 71 and 72, worm drive 84 simultaneously engages profile-shifted worm gears 73 and 74, worm drive 86 simultaneously engages profile-shifted worm gears 75 and 76, worm drive 88 engages profile-shifted worm gear 77, and worm drive 90 engages profile-shifted worm gear 78.

Figure 2:
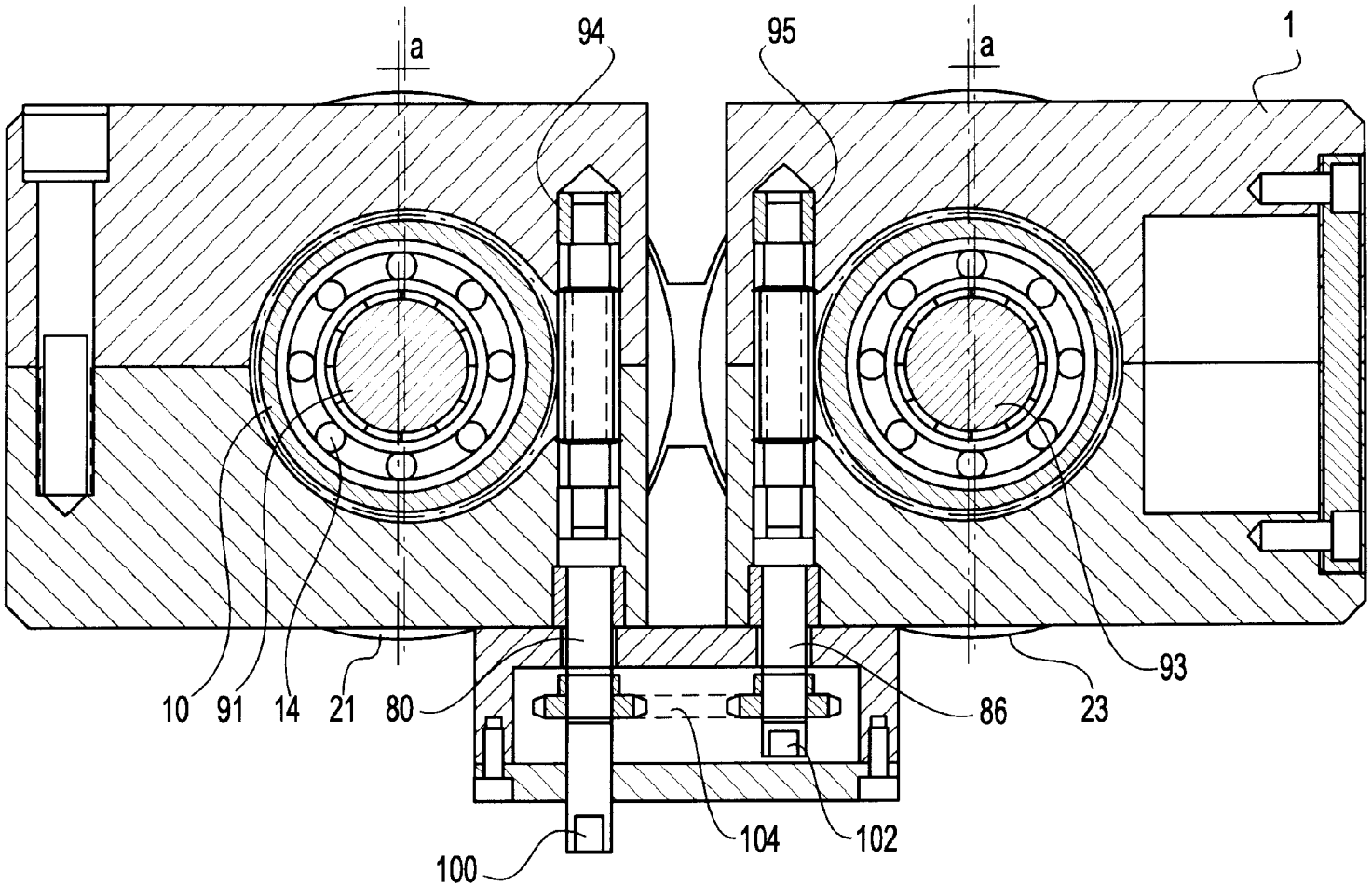
FIG. 2 is a cross sectional view of the four-roll metal rolling mill taken along line II—II of FIG. 1.

FIG. 2 shows a section view of the mill taken along line II—II of FIG. 1. As shown, worm drives 80 and 86 are shown to be largely within the case body 1, with their tips extruding from a front face of the case body. The inner most ends of the worms 80, 82, 84 and 86 inside case body 1 are mounted on bearings. Bearings 94 and 95 are shown for worm drives 80 and 86, respectively. Bearings for worm drives 82 and 84 are not shown. Sprocket wheels (only 100, 102 are visible in FIG. 2) are installed at the tips of all worms 82, 84, 86 and 88 which are linked together in a loop via a chain 104.

In the advantageous embodiment of the invention, the groove 30 at the center of the mill unit where steel rolling stock is fed through can be adjusted to accommodate rolling stock of different sizes of cross sections. The adjustment of the groove 30 is achieved via simultaneous movement of the rolls 21–24 in their respective radial planes. As the rolls 21–24 are simultaneously 'pulled' or displaced away from the center of the groove itself, the radius of the groove 30 is increased. When the rolls 21–24 are simultaneously moved toward the center from their displaced positions, groove 30 is restored to its original size.

The mechanism that implements this capability of groove adjustment lies in the eccentric bearing sleeves disposed around each of the shafts 91–94. For purposes of clarity, bearing sleeves 10, 12 and 35, 37 are shown for shafts 91 and 92, respectively. The bearing sleeves for shafts 93 and 94 are not referenced to limit the number of reference numerals shown in FIG. 1. The operation of the groove adjustment mechanism is described with reference to roll systems I and II. The operation of rolls systems III and IV will thereby be understood by one of ordinary skill in the art.

As shown in FIG. 2, bearing sleeve 10 (and all bearing sleeves disclosed herein) is eccentric in the sense that they are cylinders with eccentric bores whose circumferential walls have non-uniform thickness.

When the roll groove 30 requires adjustment, a single worm drive 80 as shown in FIG. 2, is rotated at the sprocket wheel 100 at its tip either manually or via a remotely controlled device such as a motor. The worm drive's rotation sets all the other worm drives 82, 84, 86, 88 and 90 in synchronous rotation since they are linked together by chain 104. As the worm drives rotate, they drive the corresponding profile-shifted worm gears 70–79 which causes a rotation of the respective eccentric bearing sleeves to rotate in the radial planes of the shafts 2, 3, and 91–94.

As the bearing sleeves rotate synchronously, points along the circumferences of shafts 2, 3, and 91–94 inside the sleeves will see a change in the sleeve thickness over the ball bearings due to the sleeves' built-in eccentricity. The axes of rotation of the shafts will therefore be 'pushed' by the new wall thickness and displaced by a certain distance from their original centerlines before the bearing sleeves were rotated. As a result, the rolls 21–24 riding on the shafts will move in the same radial direction as the shafts. In this way, the synchronized movement of the rolls 21–24 with respect to their common center at the groove 30 is achieved, and the size of the groove is thus adjusted. In accordance with the preferred embodiment, The position of the rolls 21–24 relative to the center of the groove 30 can be adjusted in their respective radial planes by 0.8, 1.0, 1.2 or 1.5 mm on production line or 4–6 mm off production line.

During groove adjustment, the deviation of shafts from their original centerlines could disturb the meshing between the profile-shifted spiral bevel gears that transfer the torque from the active shafts 2, 3 to the passive shafts 91–94. The ring nuts (e.g., 20, 33, 39, etc) installed on each of the shafts 2, and 91–94 enable the respective profile-shifted spiral bevel gears 32, 34, 36, 50, 52, 54 and 56 to be displaced along the shafts. With this capability, profile-shifted spiral bevel gears 32, 34, 36, 50, 52, 54 and 56 will slide into new positions along their respective shafts at the end of the groove adjustment process and properly engage profile-shifted spiral bevel gears on the other shafts.

As the external power source 308 shown in FIG. 3 delivers torque through active shaft 2, it is first passed to passive shaft 91 of roll system I and then on to profile-shifted spiral bevel gear 32 which then redirects it at a right angle to profile-shifted spiral bevel gear 34 of adjacent roll system II. This initiates or maintains synchronous rotations of the entire series of passive shafts 91–94, rolls 21–24 and the profile-shifted spiral bevel gears 32, 34, 36, 50, 52 and 54 that interconnect them in the mill unit. Shaft 3 is also connected to the external power source 308, and when active, its profile-shifted spiral bevel gear 56 will pass torque perpendicularly to profile-shifted spiral bevel gear 54 of roll system IV. The torque will eventually propagate throughout the entire assembly of roll systems in the sequence of roll system IV, III, II and then I, thereby adding more to that delivered by the original active shaft 2. The second active shaft 3 can be added to the drive train in order to provide higher input, should a greater torque be required for rolling. FIG. 3 shows that if ever active shaft 3 is installed, it will connect to an external power source 308 in the same manner as active shaft 2. A universal joint 300 connects the external end of shaft 3 to gearbox 304, which is then linked to a DC or AC motor-based power source or torque generator 308 by a coupler 306.

As the metal piece is being rolled, it experiences uniform compressions from the four respective roll radial directions, which are coplanar. This uniform compression furthermore results in an increase in the piece's strain and a reduction in its lateral strain during rolling; it also facilitates the shaping of rolling stock made of a harder metal and reduces wear on the rolls. As FIG. 3 shows, separated units of both the "+" and "X" configurations can be arranged alternatively on a single production line, thus forming a continuous rolling process. The rolling stock is effectively compressed uniformly in eight directions when it's being fed through a set of two mills of different configurations. The groove shape on each block in a production line can be customized to fulfill production requirements on per second metal flow rate and sizing and shaping of the rolling stock.

During off-line maintenance, the rolling mill is taken off the production line and the rolls are taken out of the mill block case body to be sanded down to a smaller diameter to remove wear and tear along their circumferences. The rolls can be reinstalled and the mill re-deployed in full capacity even when the rolls' diameters have been decreased by as much as 8 to 12 mm. (4 to 6 mm. in radii). The unique synchronously adjusting roll groove mechanism within the mill enables the smaller retrofit rolls to be displaced in their radial planes to compensate for the loss in diameters so that the original roll groove size can be restored. The large eccentricity built into all of the bearing sleeves of the rolling mill made displacement of the rolls possible while the shifted profiles of the profile-shifted worm and spiral bevel gears minimize the slack in the gear engagement that results from such displacement.

While there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

The invention is not limited by the embodiments described above which are presented as examples only but can be modified in various ways within the scope of protection defined by the appended patent claims.

I claim:

1. A metal rolling mill comprising:

a case body;

first drive means for actuating rotation of the metal rolling mill;

a first roll system having a shaft having a first end, a second end, a roll disposed on said shaft and extending radially therefrom, and an axis of rotation; said first end being adapted to be operatively coupled to said drive means, said second end having a profile-shifted spiral bevel gear;

a second roll system having a shaft having a first end, a second end, a roll disposed on said shaft and extending radially therefrom, an axis of rotation, and a profile-shifted spiral bevel gear disposed on said first and second ends; said profile-shifted spiral bevel gear on said first end being operatively engaged with said profile-shifted spiral bevel gear of the second end of the shaft of the first roll system such that said second roll system rotates synchronously with said first roll system;

a third roll system having a shaft having a first end, a second end, a roll disposed on said shaft and extending radially therefrom, an axis of rotation, and a profile-shifted spiral bevel gear disposed on said first and second ends; said profile-shifted spiral bevel gear on said first end being operatively engaged with said profile-shifted spiral bevel gear disposed on the second end of the second roll system shaft such that said third roll system rotates synchronously with said second roll system;

a fourth roll system having a shaft having a first end, a second end, a roll disposed on said shaft and extending radially therefrom, an axis of rotation, and a profile-shifted spiral bevel gear disposed on said first end, said profile-shifted spiral bevel gear on said first end being operatively engaged with said profile-shifted spiral bevel gear disposed on the second end of the third roll system shaft such that said fourth roll system rotates synchronously with said third roll system;

a central metal processing groove formed by said four roll systems, wherein each of said rolls of said four roll systems extends radially from its respective shaft such that a circumferential edge of each respective roll forms an outer edge of said groove; and adjustment means disposed within said case body and being integrated into each of said roll systems for enabling size adjustment of said groove;

wherein said first drive means and said four roll systems are disposed in one common plane.

2. The metal rolling mill in accordance with claim 1, wherein said adjustment means radially displaces each of said shafts, thereby radially displacing each of said rolls.

3. The metal rolling mill in accordance with claim 1, wherein said adjustment means comprises:

a pair of eccentric bearing sleeves disposed on each of said shafts on opposing sides of said rolls;

a profile-shifted worm gear disposed on an outer circumferential surface of each of said bearing sleeves;

a plurality of worm drives adapted to engage each of said profile-shifted worm gears;

an adjustment chain connecting each of said worm drives such that rotation of one worm drive causes simultaneous rotation of said plurality of worm drives, wherein rotation of said worm drives causes said eccentric bearing sleeves to rotate around said shafts resulting in radial displacement of the axes of rotation of said shafts due to the eccentricity of the bearing sleeves.

4. The metal rolling mill in accordance with claim 1, further comprising second drive means operatively coupled to said first end of said fourth roll system shaft via said profile-shifted spiral bevel gear for providing additional rotation torque to the metal rolling mill, said second drive means being arranged in the same plane as said first drive means and said four roll systems.

5. The metal rolling mill in accordance with claim 2, wherein the radial displacement of each of said rolls comprises a range of 0.8 to 1.5 mm on production line.

6. The metal rolling mill in accordance with claim 2, wherein the radial displacement of each of said rolls comprises a range of 4 to 6 mm off production line.

7. The metal rolling mill in accordance with claim 3, wherein the radial displacement of each of said rolls comprises a range of 0.8 to 1.5 mm on production line.

8. The metal rolling mill in accordance with claim 3, wherein the radial displacement of each of said rolls comprises a range of 4 to 6 mm off production line.

9. The metal rolling mill in accordance with claim 3, further comprising an ring nuts disposed at the end of each shaft and operable to maintain each of said profile-shifted spiral bevel gears in their respective meshed engagement with the profile-shifted spiral bevel gear of the next adjacent shaft during radial displacement of the axes of rotation of said shafts.

* * * * *